US009583837B2

(12) United States Patent
Xue et al.

(10) Patent No.: US 9,583,837 B2
(45) Date of Patent: Feb. 28, 2017

(54) DIFFERENTIAL PLANAR APERTURE ANTENNA

(71) Applicant: City University of Hong Kong, Kowloon (HK)

(72) Inventors: Quan Xue, New Territories (HK); Shaowei Liao, New Territories (HK); Peng Wu, Kowloon (HK)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 183 days.

(21) Appl. No.: 14/624,058

(22) Filed: Feb. 17, 2015

(65) Prior Publication Data

US 2016/0240925 A1 Aug. 18, 2016

(51) Int. Cl.
*H01Q 13/00* (2006.01)
*H01Q 9/04* (2006.01)

(52) U.S. Cl.
CPC ..... *H01Q 9/045* (2013.01)

(58) Field of Classification Search
CPC ..... H01Q 21/00; H01Q 15/06; H01Q 13/103; H01Q 13/06; H01Q 13/04; H01Q 19/193; H01Q 13/18; H01Q 11/00
See application file for complete search history.

(56) References Cited

U.S. PATENT DOCUMENTS 2,579,654 A * 12/1951 Derby ..... H01J 25/34 313/159
2,591,350 A * 4/1952 Gorn ..... H01J 25/34 315/3.5
2,658,145 A * 11/1953 Dorne ..... H01Q 13/18 333/33
5,243,357 A * 9/1993 Koike ..... H01Q 19/195 343/776
2010/0141359 A1* 6/2010 Tzuang ..... H01P 3/088 333/238

FOREIGN PATENT DOCUMENTS

SU 409139 * 3/1972

OTHER PUBLICATIONS

Pan et al. "A 60-GHz CPW-fed high-gain and broadband integrated horn antenna." IEEE Trans. Antennas Propag., vol. 57, No. 4, pp. 1050-1056, Apr. 2009.

(Continued)

*Primary Examiner* — Sue A Purvis
*Assistant Examiner* — Jae Kim
(74) *Attorney, Agent, or Firm* — Amin, Turocy & Watson, LLP

(57) ABSTRACT

A planar differential aperture antenna that has a high gain and wide bandwidth at a millimeter wave band is provided. The differential aperture antenna has a cavity within it that has a height of roughly a quarter of a wavelength of the desired transmission band. The cavity is H-shaped, and has a cross shaped patch within the cavity that is fed differentially by two grounded coplanar waveguides. Two ends of the patch extend towards the ports on either side of the differential aperture antenna, and the other two ends of the patch extend into the cavity lobes, perpendicular with respect to the ports.

20 Claims, 8 Drawing Sheets

(56) References Cited

OTHER PUBLICATIONS

Wang et al. "Dielectric loaded substrate integrated waveguide (SIW)-plane horn antennas." IEEE Trans. Antennas Propag., vol. 58, No. 3, pp. 640-647, Mar. 2010.
Ghassemi et al. "Millimeter-wave integrated pyramidal horn antenna made of multilayer printed circuit board (PCB) process." IEEE Trans. Antennas Propag., vol. 60, No. 9, pp. 4432-4435, Sep. 2012.
Elboushi et al. "High-Gain Hybrid Microstrip/Conical Horn Antenna for MMW Applications." IEEE Antennas Wireless Propag. Lett.,vol. 11, pp. 129-132, 2012.
Enayati et al. "Millimeter-Wave Horn-Type Antenna-in-Package Solution Fabricated in a Teflon-Based Multilayer PCB Technology." IEEE Trans. Antennas Propag., vol. 61, No. 4, pp. 1581-1590, Apr. 2013.

* cited by examiner

500

| Parameter | $g_x$ | $g_y$ | $c_x$ | $c_y$ | $m_x$ | $m_y$ | $t$ | $h$ |
|---|---|---|---|---|---|---|---|---|
| Value (mm) | 14.0 | 12.0 | 6.7 | 8.5 | 1.3 | 6.2 | 0.6 | 0.787 |
| Value ($\lambda_0$)* | 2.8 | 2.4 | 1.34 | 1.7 | 0.26 | 1.24 | 0.12 | 0.16 |
| Parameter | $s_x$ | $s_y$ | $f_w$ | $f_p$ | $m_x$ | $m_y$ | $d$ | $c_d$ |
| Value(mm) | 0.7 | 0.2 | 0.3 | 0.5 | 1.3 | 1.3 | 0.3 | 0.75 |
| Value ($\lambda_0$) | 0.14 | 0.04 | 0.06 | 0.1 | 0.22 | 0.26 | 0.06 | 0.15 |

DIFFERENTIAL PLANAR APERTURE ANTENNA

TECHNICAL FIELD

This disclosure relates generally to a differential planar aperture antenna that has a high gain and wide bandwidth at a millimeter wave band.

BACKGROUND

Conventional high gain aperture antennas, such as a parabolic reflector antenna, are widely used for millimeter-wave bands in different areas, because of their high gain, wide bandwidth and simple structure. However, these antennas have a large profile with regards to the beam direction, large size and relatively high cost. To overcome the drawbacks of conventional millimeter-wave high gain aperture antennas, different millimeter-wave planar aperture antennas, e.g., horn and horn-like antenna, using different planar circuit technologies have been proposed, but these designs suffer from either low gain or high cost.

SUMMARY

The following presents a simplified summary of the specification in order to provide a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later. It will also be appreciated that the detailed description may include additional or alternative embodiments beyond those described in this summary.

In various non-limiting embodiments, a differential aperture antenna can include a pair of grounded coplanar waveguides and a first port formed between a first set of ends of the pair of grounded coplanar waveguides and a second port formed between a second set of ends of the pair of grounded coplanar waveguides. The differential aperture antenna can also include a cavity formed between the pair of grounded coplanar waveguides, a ground surface, and a surface metal strip, wherein the cavity comprises lobes, wherein the lobes are substantially symmetric across an axis between the first port and the second port. The differential aperture antenna can additionally include a patch that extends into the lobes and into the first port and the second port, wherein the patch is symmetric across the first axis and across a second axis between respective ends of the lobes.

In another embodiment, a method comprises receiving, by an apparatus, a transmission at a first port formed between two waveguides. The method can also comprise coupling the transmission to a patch that is across an opening of the first port from a ground plane. The method can also comprise guiding the transmission as a surface wave along the patch to a cavity and splitting the transmission into two parts and guiding the two parts to respective ends of the patch that extend into openings of the cavity. The method can also include exciting a uniform aperture field distribution in the cavity based on the two parts of the transmission.

In another example embodiment, a method for fabricating a differential aperture antenna comprises forming a pair of waveguides that have two ports between respective ends of the grounded coplanar waveguides. The method can also include forming a cavity between a ground surface and a surface metal strip, wherein the cavity comprises two lobes, wherein the two lobes are symmetric across an axis between the first port and the second port. The method can also include forming a metal patch in the cavity opposite a ground plane, wherein the patch is cross shaped and extends into the two lobes and the two ports.

The following description and the annexed drawings set forth certain illustrative aspects of the specification. These aspects are indicative, however, of but a few of the various ways in which the principles of the specification may be employed. Other novel aspects of the specification will become apparent from the following detailed description of the specification when considered in conjunction with the drawings.

BRIEF DESCRIPTION OF THE DRAWINGS

Non-limiting and non-exhaustive embodiments of the subject disclosure are described with reference to the following figures, wherein like reference numerals refer to like parts throughout the various views unless otherwise specified.

DETAILED DESCRIPTION

Figure 1:
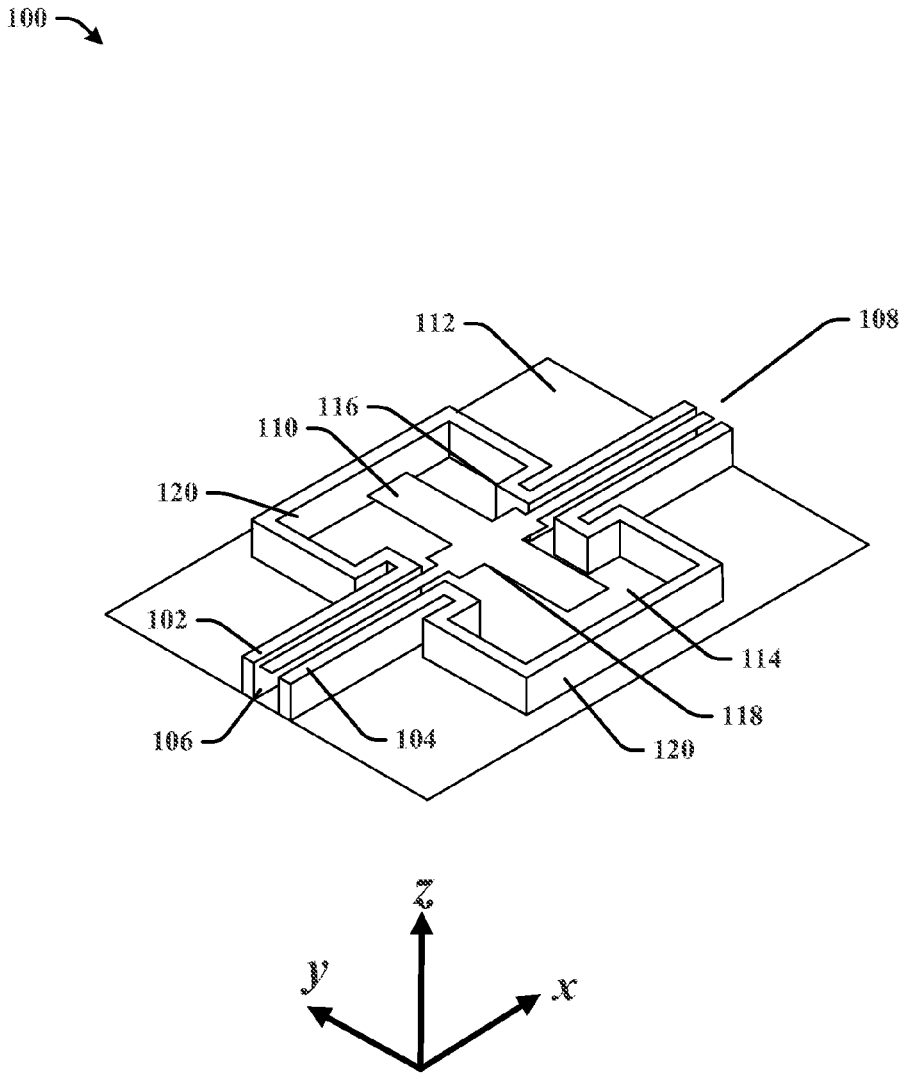
FIG. 1 illustrates an example embodiment of a differential aperture antenna in accordance with various aspects and embodiments described herein.

In the following description, numerous specific details are set forth to provide a thorough understanding of various embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

As an overview of the various embodiments presented herein, a planar differential aperture antenna that has a high gain and wide bandwidth at a millimeter wave band is provided. The differential aperture antenna has a cavity within it that has a height of roughly a quarter of a wavelength of the desired transmission band. The cavity is H-shaped, and has a cross shaped patch within the cavity that is fed differentially by two grounded coplanar waveguides. Two ends of the patch extend towards the ports on either side of the differential aperture antenna, and the other two ends of the patch extend into the cavity lobes, perpendicular with respect to the ports. The proposed aperture antenna is symmetrical about both XZ-plane (i.e., E-plane) and YZ-plane (i.e., H-plane), where X is the direction of the transmission, Z is the vertical axis, and Y is the horizontal axis. The differential aperture antenna does not resonate like a typical antenna and instead a virtual AC ground line is formed across the patch extending into the lobes, where electromagnetic fields from the travelling waves on each side of the patch, arriving from the differential ports cancel out.

In an embodiment, a length and a width of the cavity are larger than one wavelength to enable a larger aperture and high aperture efficiency. Unlike traditional aperture antennas where the field distribution in the cavity forms resonant modes, in the subject disclosure, the energy associated with a transmission is fed into the cavity through both differential ports and splits into two parts and then propagates along the patch in the positive and negative Y direction in the form of a travelling wave. The energy on the patch excites a uniform aperture field distribution which allows a high aperture efficiency. Furthermore, the field around the edge of the cavity also contributes to the radiation, and helps increase the aperture and gain of the antenna. Therefore, the actual aperture of the proposed aperture antenna is larger than the physical aperture formed by the ports.

In an embodiment, to ensure the highest aperture E-field amplitude, the height of the cavity is one quarter-wavelength ($\lambda_g/4$), which is corresponding to the thickness of commercially available laminates at millimeter-wave band. One quarter-wavelength ($\lambda_g/4$) in the materials of two widely used commercial laminates, i.e., RT/duroid 5880 and 6010, at different frequencies in millimeter-wave band is given in the table in FIG. 5. Therefore, the proposed aperture antenna is compatible with standard planar circuit technology, such as Print-Circuit-Broad (PCB technology) and Low Temperature Co-fired Ceramic (LTCC), at millimeter-wave band, and is very suitable for various millimeter-wave applications.

Turning now to FIG. 1, illustrates an example embodiment of a differential aperture antenna 100 in accordance with various aspects and embodiments described herein. The differential aperture antenna 100 include a ground plane 112 (e.g., on a printed circuit board), with two waveguides 102 and 104. In an embodiment, the waveguides 102 and 104 can be grounded co-planar waveguides. In other embodiments, the waveguides 102 and 104 can be microstrip lines, substrate integrated waveguide, or other transmission lines.

A cavity 114 can be formed between a ground plane 112 and a surface metal strip (not shown) with cavity walls 120 formed by metal pins or vias between the ground plane 112 and the surface metal strip. The waveguides 102 and 104 can be formed on the inside of the cavity wall 120 and shaped such that a cavity 114 is formed between the waveguides 102 and 104 and cavity wall 120. The cavity can have two openings, or ports 106 and 108 that are the physical apertures of the differential aperture antenna. A patch 110 can then be placed inside the cavity 114 with ends extending into each of the lobes of the cavity 114 and the ports 106 and 108.

In an embodiment, the cavity 114 can be H-shaped, or lobed, with the lobes extending along the y axis, which is perpendicular to the direction of the incoming and outgoing transmissions. The lobes can have a larger cross section (along the x axis) at a distal end of the lobe relative to the cross section of the cavity near the axis formed by the ports 106 and 108. The location and size of the step 116 where the cavity enlarges, forming the lobe, are designed to optimize the performance of the differential aperture antenna, by adjusting the distribution of the high and low frequency bands. Similar steps on the patch at 118 serve a similar function as the step 116.

It is to be appreciated that while the shape of the cavity shown in FIG. 1 is roughly H-shaped with squared corners, in other embodiments, other configurations are possible with rounded corners, circular, elliptical, or asymmetric lobes, and other shapes.

In an embodiment, the patch 110 can be a metal patch that is attached to a top surface of the antenna 100. The metal patch can be communicably coupled to a differential input or output port that extracts a signal from the transmission and outputs the signal to a receiver. In an embodiment, the patch is cross-shaped, or X-shaped, with ends extending into each of the lobes of the cavity 114 and the ports 106 and 108.

Figure 2:
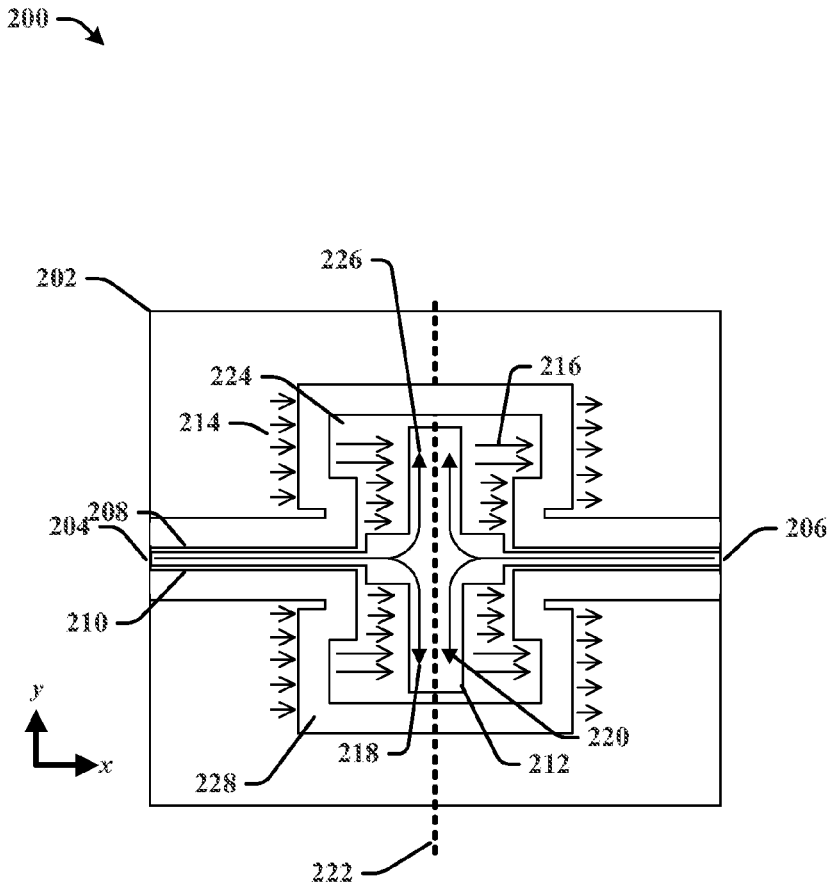
FIG. 2 illustrates an example embodiment of a differential aperture antenna in accordance with various aspects and embodiments described herein.

Turning now to FIG. 2, illustrated is a differential aperture antenna 200 in accordance with various aspects and embodiments described herein. The differential aperture antenna 200 include a ground plane 202 (e.g., on a printed circuit board), with two waveguides 208 and 210. In an embodiment, the waveguides 208 and 210 can be grounded co-planar waveguides. In other embodiments, the waveguides 208 and 210 can be microstrip lines, substrate integrated waveguide, or other transmission lines.

The cavity wall 228 can be shaped such that a cavity 224 is formed within the cavity wall 228. The cavity can have two openings, or ports 204 and 206 that are the physical apertures of the differential aperture antenna. Grounded co-planar waveguides 208 and 210 can feed a patch 212 that is placed inside the cavity 224 with ends extending into each of the lobes of the cavity 224 and the ports 204 and 206.

In an embodiment, a length and a width of the cavity 224 are larger than one wavelength to enable a larger aperture and high aperture efficiency. Unlike traditional aperture antennas where the field distribution in the cavity forms resonant modes, in the subject disclosure, the energy associated with a transmission is fed into the cavity through both differential ports 204 and 206 and splits into two parts 218 and 226 and then propagates along the patch 212 in the positive and negative Y direction in the form of a travelling wave. The energy on the patch 212 excites a uniform aperture field distribution 216 which allows a very high aperture efficiency. Furthermore, the field 214 around the edge of the cavity 224 and waveguide 208 and 210 also contributes to the radiation, and helps increase the aperture and gain of the antenna 200. Therefore, the actual aperture of the proposed aperture antenna is larger than the physical aperture formed by the ports.

The differential aperture antenna 200 is symmetrical about both XZ-plane (i.e., E-plane) and YZ-plane (i.e., H-plane), where X is the direction of the transmission, Z is the vertical axis, and Y is the horizontal axis. The differential aperture antenna 200 does not resonate like a typical antenna and instead a virtual AC ground line 222 is formed across the patch extending into the lobes, where electromagnetic fields from the differentially fed patch cancel out (e.g., 218 and 220).

Figure 3:
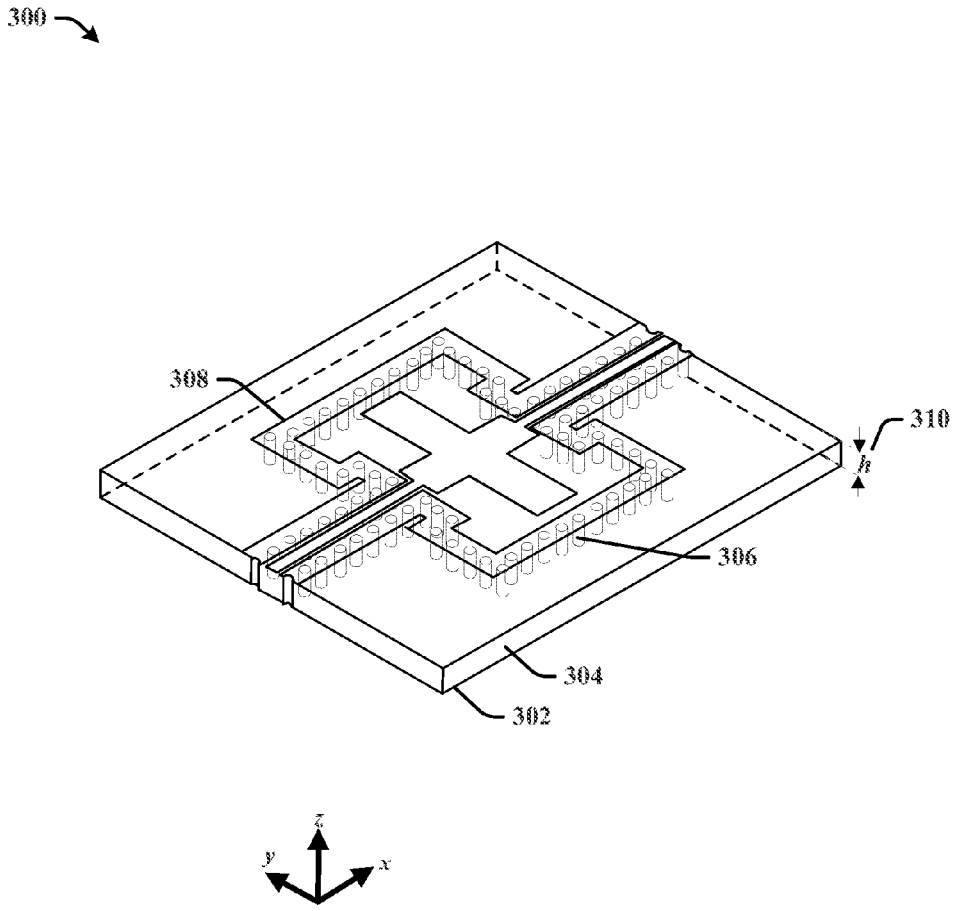
FIG. 3 illustrates a 3D view of an example embodiment of a differential aperture antenna in accordance with various aspects and embodiments described herein.

Turning now to FIG. 3, illustrated is a 3D view of an example embodiment of a differential aperture antenna 300 in accordance with various aspects and embodiments described herein. The differential aperture antenna 300 can be based on a single layer substrate 304 with a height "h" 310. In an embodiment, the substrate 304 can include a ground plane 302. In an embodiment, metalized vias 306 or pegs can be formed in the substrate, and be joined together by a surface layer 308 formed of copper or another suitable metal to form the walls of the cavity within the antenna.

In an embodiment, the substrate 304 can be single-layer RT/duroid 5880 ($\in r$=2.2, tan $\sigma$=0.0009) substrate with the thickness 310 of 0.787 mm and copper layer thickness of 9 μm using standard PCB technology. The substrate thickness 0.787 mm corresponds to approximate a quarter-wavelength in the dielectric substrate 304 for a transmission sent in the 60 GHz band. To feed the antenna, a differential feeding network with input or output ports can also be implemented, communicably coupled to the patch.

Figures 4, 5:
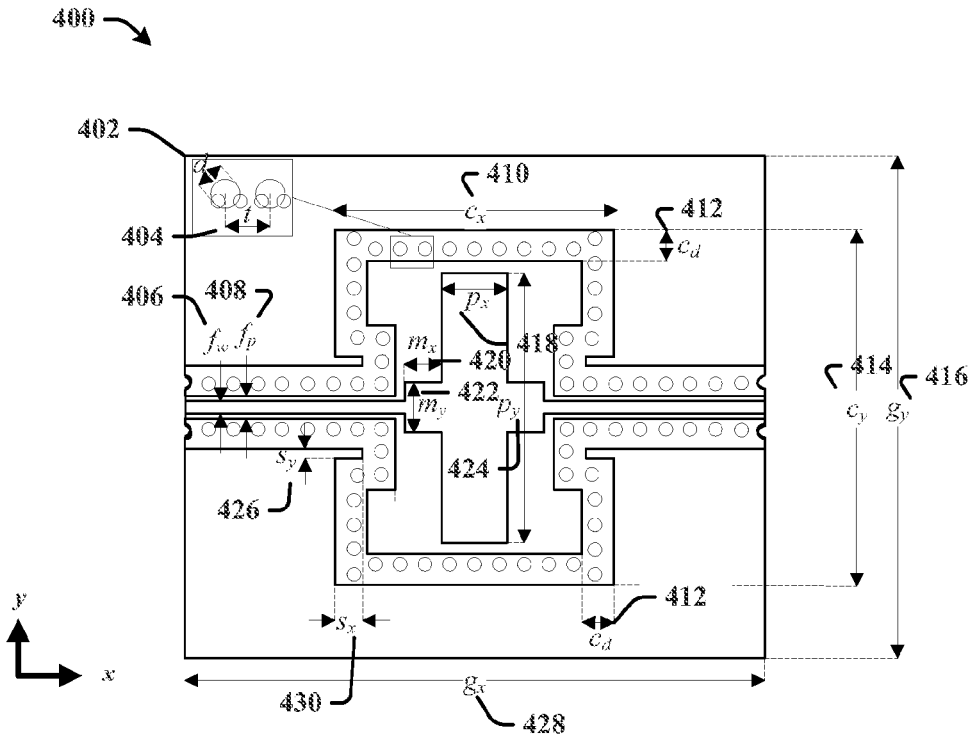
FIG. 4 illustrates an example embodiment of a differential aperture antenna in accordance with various aspects and embodiments described herein.
FIG. 5 illustrates a table with various parameters for a differential aperture antenna in accordance with various aspects and embodiments described herein.

Turning now to FIG. 4, illustrated is an example embodiment of a differential aperture antenna 400 in accordance with various aspects and embodiments as described herein. FIG. 4 displays labels describing various parameters and dimensions of the differential aperture antenna 400 as described herein. It is to be appreciated that while the embodiment shown in FIG. 4 corresponds to the embodiment described in FIG. 3 above, the parameters can also apply to the embodiments shown in FIGS. 1 and 2 above as well.

Table 500 in FIG. 5 shows exemplary ranges and examples of the values for the parameters shown in FIG. 4. For example, 402 $d$, which is the diameter of the metalized via can be 0.3 mm or 0.06λ. The value 404 $t$, which is the spacing between the vias can be 0.6 mm or 0.12λ. 406 $f_w$, and 408 $f_p$ which are the width of the patch in the port and the spacing between the waveguides in the part are 0.3 mm and 0.5 mm respectively, or 0.06λ and 0.1λ. 412 $c_d$ which is the width of the waveguide is 0.75 mm, and 410 $c_x$ which is the width of the lobe at the widest part is 6.7 mm. 414 $c_y$, which is the length of the lobe in the y direction, and 416 $g_y$, which is the length of the antenna 400 in the y direction are 8.5 mm and 12 mm respectively. 418 $p_x$ and 424 $p_y$ are width and length of the patch and are 1.3 mm and 6.2 mm respectively. 420 $m_x$ and 422 $m_y$ are the lengths of the step in the patch and are 1.1 mm and 1.3 mm respectively. 426 $s_y$ and 430 $s_x$ are the dimensions of the step in the waveguide, and are 0.2 mm and 0.7 mm. 428 $g_x$ is width of the antenna 400 and is 14.0 mm. It is to be appreciated that these values are merely exemplary embodiments, and that deviations from those values are possible.

Figure 6:
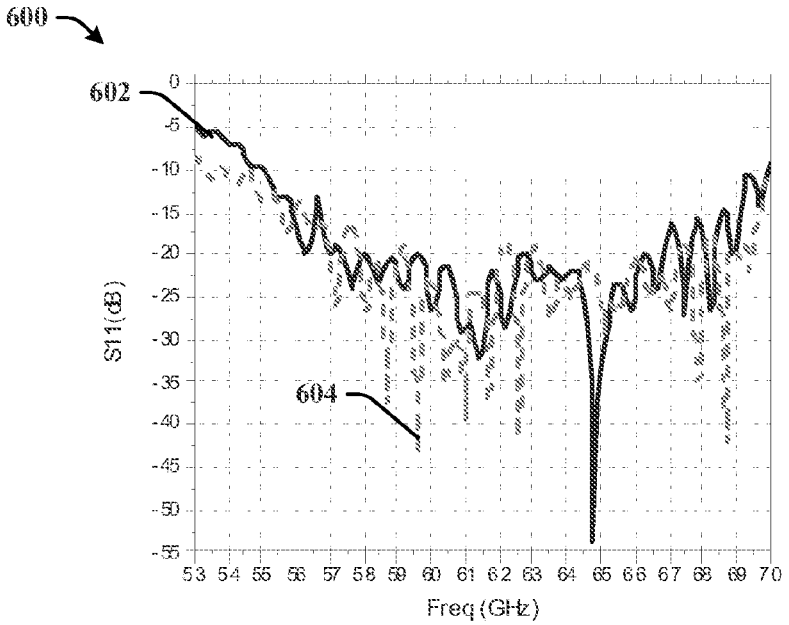
FIG. 6 illustrates a graph showing simulated and measured reflection coefficients of a differential aperture antenna in accordance with various aspects and embodiments described herein.

Turning now to FIG. 6, illustrated is a graph 600 showing the simulated and measured reflection coefficients of a differential aperture patch antenna in accordance with various aspects and embodiments described herein. The line 602 shows the simulated reflection coefficient and the line 604 shows the measured reflection coefficient. The simulated and measured −15-dB impedance bandwidths are from 56.7 to 69 GHz (19.6%) and from 56.2 to 69.7 GHz (21.5%), respectively.

Figure 7:
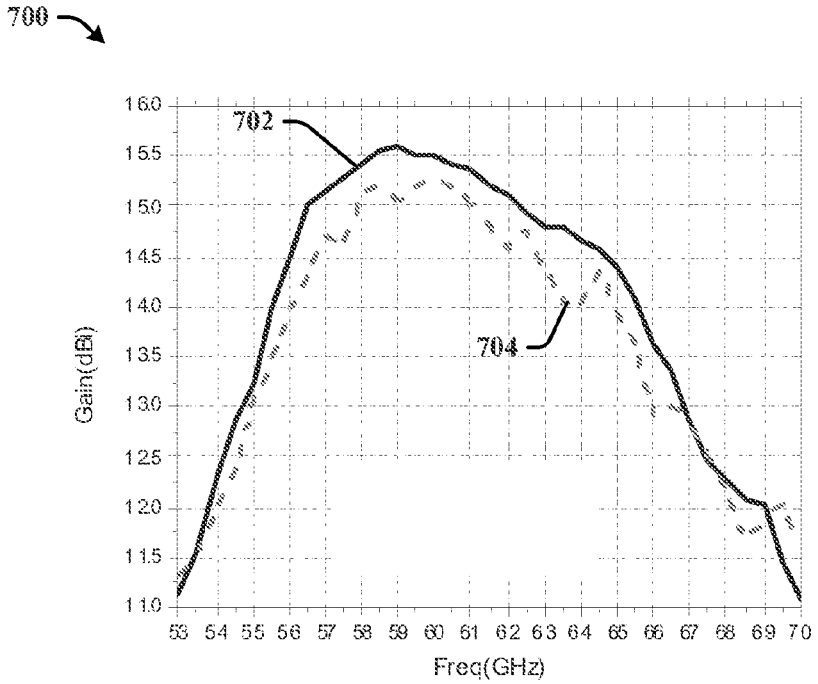
FIG. 7 illustrates a graph showing simulated and measured gain of a differential aperture antenna in accordance with various aspects and embodiments described herein.

Turning now to FIG. 7, illustrated is a graph 700 showing simulated and measured gain of a differential aperture antenna in accordance with various aspects and embodiments described herein. The line 702 shows the simulated gain and the line 704 shows the measured gain. The simulated and measured insertion losses of the back-to-back test of the differential feeding network are used to calibrate the simulated and measured gain, respectively. As can been seen, two results are similar but the measured gain 704 is around 0.3 dB lower than the simulated gain 702, which is acceptable considering the difference between the simulation and measurement. For the simulated gain 702, the peak gain is 15.6 dB with the 3-dB gain bandwidth from 54.5 to 67.8 GHz. For the measured gain 704, the peak gain is 15.3 dB with the 3-dB gain bandwidth from 54.0 to 67.5 GHz (22.2%). Since the insertion loss of the differential feeding network from back-to-back test is only a part of the insertion loss of the overall differential feeding network, the actually simulated and measured gain may be even higher.

Figure 8:
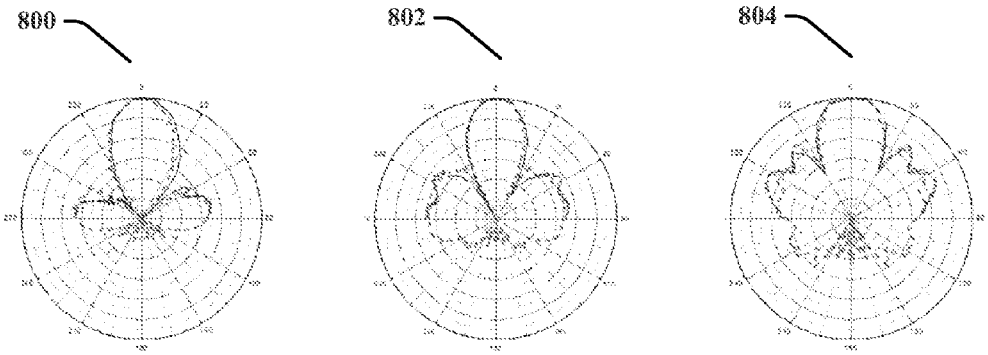
FIG. 8 illustrates a graph showing simulated and measured normalized radiation patterns of a differential aperture antenna in a plane in accordance with various aspects and embodiments described herein.

Turning now to FIG. 8, illustrated are graphs 800, 802, and 804 showing simulated and measured normalized radiation patterns of a differential aperture antenna in a plane in accordance with various aspects and embodiments described herein. Each of the graphs 800, 802, and 804 show simulated and measured radiation patterns for the xz plane of the differential aperture antenna. Graph 800 shows the simulated and measured radiation patterns for the xz plane at 57 Hz. Graph 802 shows the simulated and measured radiation patterns for the xz plane at 61.5 Hz. Graph 804 shows the simulated and measured radiation patterns for the xz plane at 66 Hz.

Figure 9:
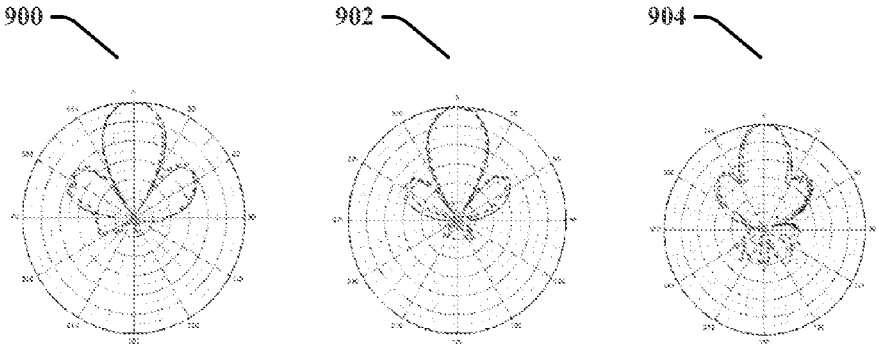
FIG. 9 illustrates a graph showing simulated and measured normalized radiation patterns of a differential aperture antenna in another plane in accordance with various aspects and embodiments described herein

Turning now to FIG. 9, illustrated are graphs 900, 902, and 904 showing simulated and measured normalized radiation patterns of a differential aperture antenna in a plane in accordance with various aspects and embodiments described herein. Each of the graphs 900, 902, and 904 show simulated and measured radiation patterns for the yz plane of the differential aperture antenna. Graph 900 shows the simulated and measured radiation patterns for the yz plane at 57 Hz. Graph 902 shows the simulated and measured radiation patterns for the yz plane at 61.5 Hz. Graph 904 shows the simulated and measured radiation patterns for the yz plane at 66 Hz. Even though the overall structure isn't symmetrical about the YZ-plane because of the connecting differential feeding network, the co-polarization radiation patterns are still generally symmetrical on the xz- and yz-plane for both measurement and simulation. Due to the asymmetry of the overall structure on yz-plane, the cross polarization appears on xz-plane. Nevertheless, the simulated cross-polarization on xz-plane is lower than −30 dB and isn't shown in FIGS. 8 and 9. The measured cross-polarization is also very low. For all the frequencies and planes, it is lower than −24 dB, as shown in FIGS. 8 and 9.

Figure 10:
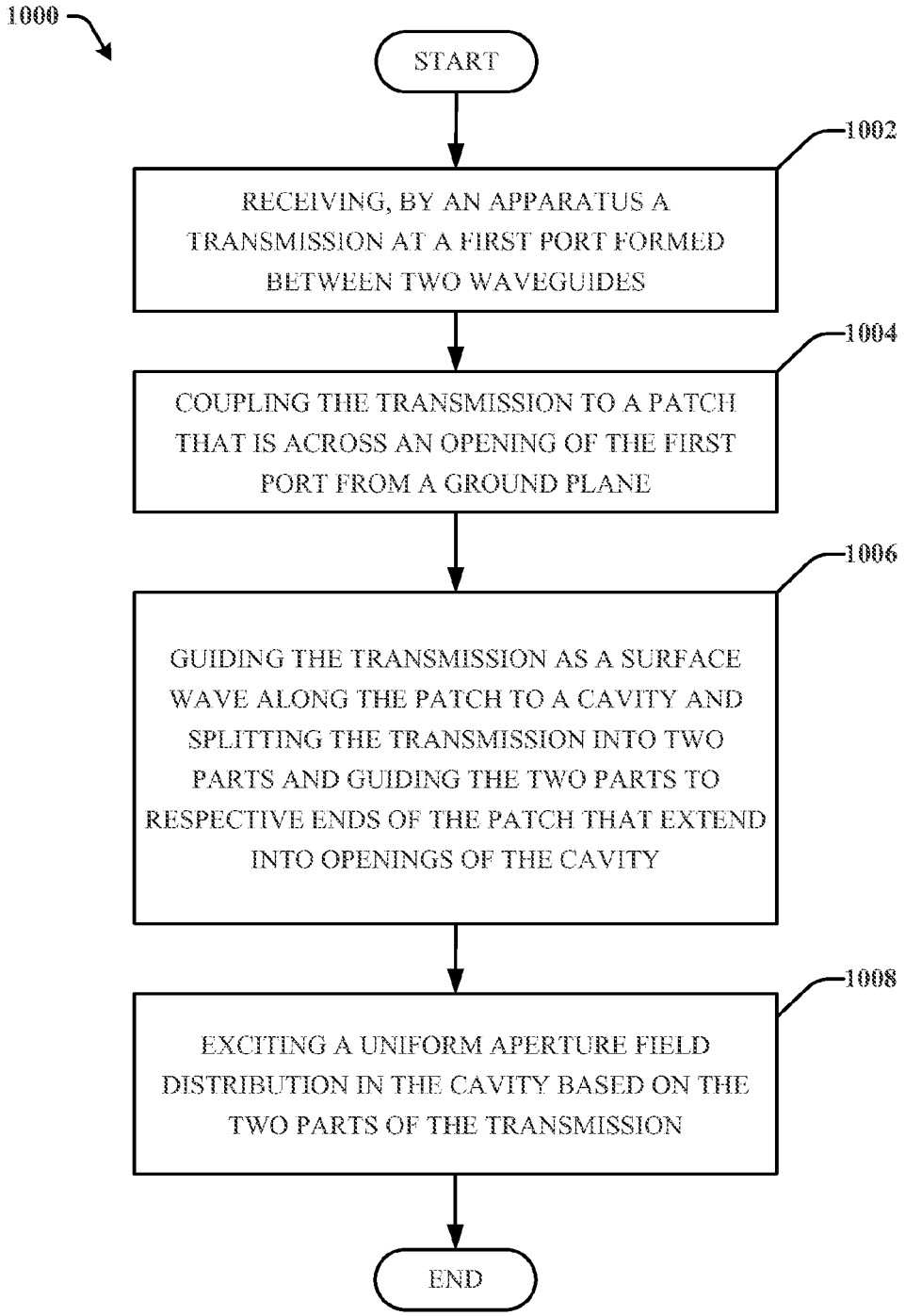
FIG. 10 illustrates a method for receiving a transmission via a differential aperture antenna in accordance with various aspects and embodiments.
Figure 11:
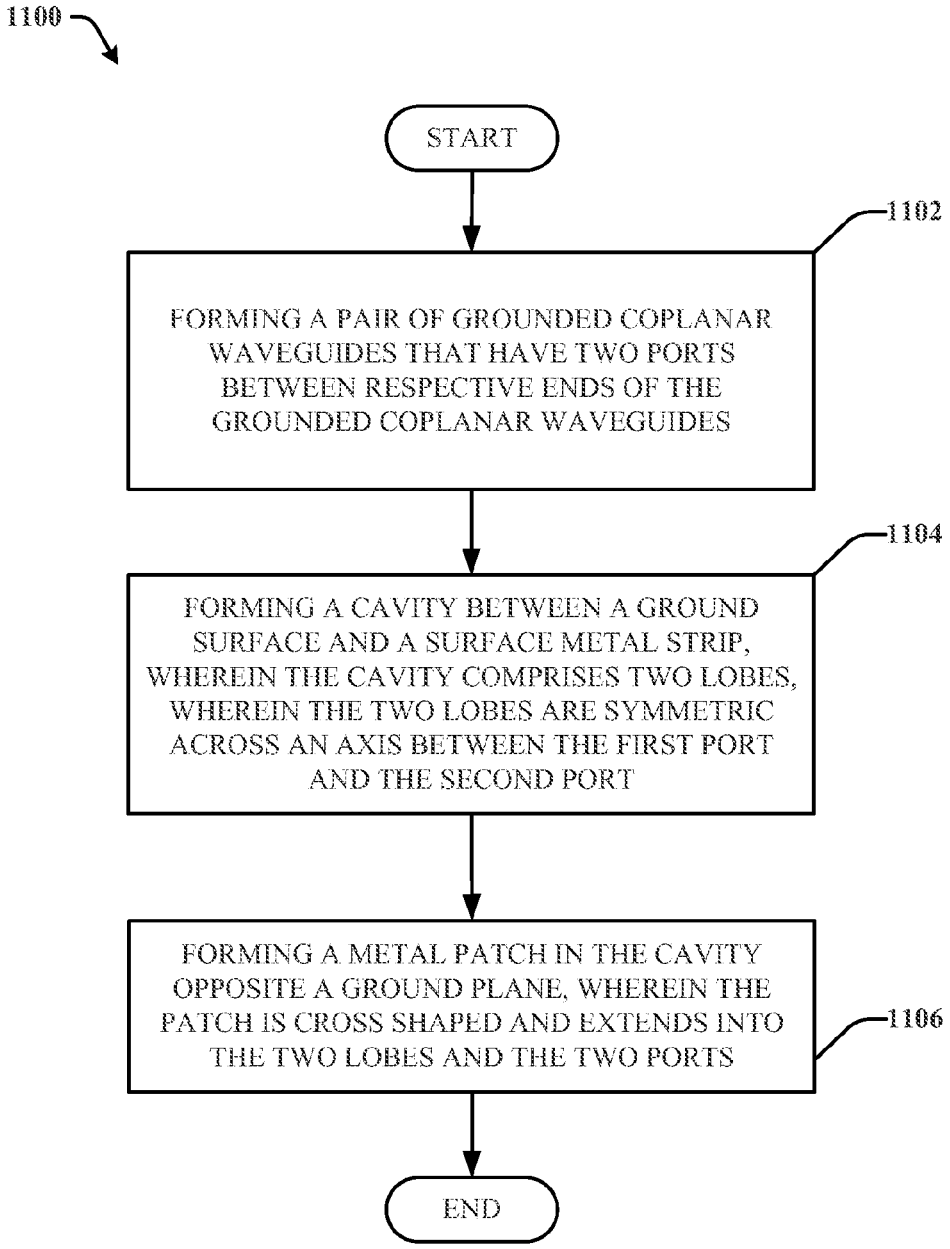
FIG. 11 illustrates a method for fabricating a differential aperture antenna in accordance with various aspects and embodiments.

FIGS. 10-11 illustrate processes in connection with the aforementioned systems. The processes in FIG. 10-11 can be implemented for example by the embodiments shown in FIGS. 1-9. While for purposes of simplicity of explanation, the methods are shown and described as a series of blocks, it is to be understood and appreciated that the claimed subject matter is not limited by the order of the blocks, as some blocks may occur in different orders and/or concurrently with other blocks from what is depicted and described herein. Moreover, not all illustrated blocks may be required to implement the methods described hereinafter.

FIG. 10 illustrates an example, non-limiting method 1000 for receiving a transmission via differential aperture antenna in accordance with various aspects and embodiments. Method 1000 can start at 1002 where a transmission is received, by an apparatus (e.g., the differential aperture antenna) at a first port formed between two waveguides. At 1004, the method includes coupling the transmission to a patch that is across an opening of the first port from a ground plane. At 1006, the methods includes guiding the transmission as a surface wave along the patch to a cavity and splitting the transmission into two parts and guiding the two parts to respective ends of the patch that extend into openings of the cavity. At 1008, the method includes exciting a uniform aperture field distribution in the cavity based on the two parts of the transmission FIG. 11 illustrates a method 1100 for fabricating a differential aperture antenna in accordance with various aspects and embodiments. Method 1100 can begin at 1102 where a pair of waveguides are formed such that two ports between respective ends of the grounded coplanar waveguides are formed.

At 1104, the method includes forming a cavity between a ground surface and a surface metal strip, wherein the cavity comprises two lobes, wherein the two lobes are symmetric across an axis between the first port and the second port. At 1106, the method includes forming a metal patch in the cavity opposite a ground plane, wherein the patch is cross shaped and extends into the two lobes and the two ports.

Reference throughout this specification to "one embodiment," or "an embodiment," means that a particular feature, structure, or characteristic described in connection with the embodiment is included in at least one embodiment. Thus, the appearances of the phrase "in one embodiment," "in one aspect," or "in an embodiment," in various places throughout this specification are not necessarily all referring to the same embodiment. Furthermore, the particular features, structures, or characteristics may be combined in any suitable manner in one or more embodiments.

Further, these components can execute from various computer readable media having various data structures stored thereon. The components can communicate via local and/or remote processes such as in accordance with a signal having one or more data packets (e.g., data from one component interacting with another component in a local system, distributed system, and/or across a network, e.g., the Internet, a local area network, a wide area network, etc. with other systems via the signal).

As another example, a component can be an apparatus with specific functionality provided by mechanical parts operated by electric or electronic circuitry; the electric or electronic circuitry can be operated by a software application or a firmware application executed by one or more processors; the one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components. In an aspect, a component can emulate an electronic component via a virtual machine, e.g., within a cloud computing system.

The words "exemplary" and/or "demonstrative" are used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, such terms are intended to be inclusive—in a manner similar to the term "comprising" as an open transition word—without precluding any additional or other elements.

The herein described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the subject disclosure have been described herein for purposes of illustration, and that various modifications may be made without departing from the scope and spirit of the subject disclosure. Accordingly, the various embodiments disclosed herein are not intended to be limiting, with the true scope and spirit being indicated by the following claims.

What is claimed is:

1. A differential aperture antenna, comprising:

a pair of grounded coplanar waveguides;

a first port formed at a first free end of a first coplanar waveguide of the pair of grounded coplanar waveguides and a second port formed at a second free end of a second coplanar waveguide of the pair of grounded coplanar waveguides;

an H-shaped cavity formed on a ground surface between the pair of grounded coplanar waveguides, and a surface metal strip, wherein the cavity comprises lobes, wherein the lobes are substantially symmetric across an axis between the first port and the second port; and a cross shaped patch within the cavity and above the ground surface comprising a pair of first arms that extend the lobes, respectively, and a pair of second arms that extend towards and connect to the first port and the second port, respectively, wherein the cross shaped patch is symmetric across the first axis and across a second axis between respective ends of the lobes, and wherein the first arms are longer than the second arms.

2. The differential aperture antenna of claim 1, wherein the cross shaped patch is fed by a pair of microstrip lines.

3. The differential aperture antenna of claim 1, wherein the cross shaped patch is fed by a pair of substrate integrated waveguides.

4. The differential aperture antenna of claim 1, wherein a transmission received by the differential aperture antenna is guided along the cross shaped patch as a surface wave to the H-shaped cavity.

5. The differential aperture antenna of claim 1, wherein a height of the ports and the cross shaped cavity is equivalent to a quarter of a wavelength of a transmission received by the differential aperture antenna.

6. The differential aperture antenna of claim 1, wherein the cross shaped patch comprises a metal patch.

7. The differential aperture antenna of claim 1, wherein an actual aperture is larger than a physical aperture formed by the first port and the second port.

8. The differential aperture antenna of claim 1, wherein a width of the H-shaped cavity and a length of the H-shaped cavity are longer than a wavelength of a transmission received by the differential aperture antenna.

9. The differential aperture antenna of claim 1, wherein the H-shaped cavity is also formed by metal vias between the ground and the surface metal strip.

10. The differential aperture antenna of claim 1, wherein the substrate is around 0.787 mm.

11. The differential aperture antenna of claim 9, wherein the cross shaped patch is communicably coupled to a differential output or input port.

12. A method, comprising:

receiving, by an apparatus, a transmission between two waveguides of the apparatus comprising a first waveguide and a second waveguide, wherein the first waveguide comprises a first port formed at a first free end of the first waveguide, and wherein the second waveguide comprises a second port formed at a second free end of the second waveguide;

coupling the transmission to a cross shaped patch that is within an H-shaped cavity and across an opening of the first port from a ground plane, wherein the H-shaped cavity is formed on the ground plane between the two waveguides and a surface metal strip, wherein the H-shaped cavity comprises lobes that are symmetric across an axis between the first port and the second port, wherein the cross shaped patch comprises first arms that extend into the lobes, respectively, and second arms that extend towards and connect to the first port and the second port respectively, wherein the first arms are lon er than the second arms and wherein the cross shaped patch is symmetric across the first axis and across a second axis between respective ends of the lobes;

guiding the transmission as a surface wave along the cross shaped patch to the H-shaped cavity;

splitting the transmission into two parts;

guiding the two parts to respective ends of the cross shaped patch that extend into openings of the H-shaped cavity; and exciting a uniform aperture field distribution in the H-shaped cavity based on the two parts of the transmission.

13. The method of claim 12, further comprising:

coupling a differential transmission to the cross shaped patch at the second port; and guiding the differential transmission along the cross shaped patch to the H-shaped cavity, thereby splitting the differential transmission into another two parts and guiding the other two parts to the respective ends of the cross shaped patch.

14. The method of claim 13, wherein the two parts of the transmission and the other two parts of the differential transmission are on opposite sides of the cross shaped patch.

15. The method of claim 14, further comprising:

forming a virtual alternating current ground line between the two parts of the transmission and the other two parts of the differential transmission.

16. The method of claim 13, wherein the exciting the uniform aperture field distribution is based on the transmission, the differential transmission, and electromagnetic radiation associated with the transmission outside the H-shaped cavity.

17. A method for fabricating a differential aperture antenna, comprising:

forming a pair of grounded coplanar waveguides that have two ports between respective ends of the grounded coplanar waveguides, wherein the two ports comprise a first port formed at a first free end of a first coplanar waveguide of the pair of grounded coplanar waveguides and a second port formed at a second free end of a second coplanar waveguide of the pair of grounded coplanar waveguides;

forming an H-shaped cavity on a ground surface between the pair of grounded coplanar waveguides, and a surface metal strip, wherein the H-shaped cavity comprises two lobes, wherein the two lobes are symmetric across an axis between the first port and the second port; and forming a metal cross shaped patch in the H-shaped cavity opposite a ground plane, wherein the metal cross shaped patch extends into the two lobes and the two ports, wherein the cross shaped patch is above the ground surface, wherein the cross shaped patch comprises a air of first arms that extend into the lobes respectively and a pair of second arms that extend towards and connect to the first port and the second port, respectively, wherein the first arms are longer than the second arms, and wherein the cross shaped patch is symmetric across the first axis and across a second axis between respective ends of the lobes.

18. The method of claim 17, wherein a distance between the metal cross shaped patch and the ground plane is about a quarter of a wavelength of a transmission received by the differential aperture antenna.

19. The method of claim 17, wherein the forming the pair of grounded coplanar waveguides comprises forming the pair of grounded coplanar waveguides in electrical contact with the ground plane.

20. The method of claim 17, wherein the H-shaped cavity is also formed by metal vias between the ground surface and the surface metal strip.

* * * * *